United States Patent [19]

van Herpen

[11] 4,063,763

[45] Dec. 20, 1977

[54] DOOR OR WINDOW CLOSURE

[76] Inventor: Frederik Cornelis van Herpen, 90, Stationsweg, Barendrecht, Netherlands

[21] Appl. No.: 685,982

[22] Filed: May 13, 1976

[30] Foreign Application Priority Data

May 21, 1975 Netherlands ..... 7505995

[51] Int. Cl.[2] ..... E05C 1/06

[52] U.S. Cl. ..... 292/39; 292/160

[58] Field of Search ..... 292/1, 9, 51, 39, 112, 292/142, 160, 199, 337

[56] References Cited

U.S. PATENT DOCUMENTS

| | | | |
|---|---|---|---|
| 543,880 | 8/1895 | Lutz | 292/1 X |
| 1,724,216 | 8/1929 | Neiser | 292/1 |
| 2,608,084 | 8/1952 | Poulson | 292/142 X |
| 3,222,898 | 12/1965 | Lunsford | 292/142 X |

FOREIGN PATENT DOCUMENTS

| | | | |
|---|---|---|---|
| 1,238,884 | 7/1960 | France | 292/160 |
| 1,276,043 | 10/1961 | France | 292/1 |
| 1,461,604 | 11/1966 | France | 292/160 |
| 1,559,735 | 8/1969 | Germany | 292/142 |
| 1,908,478 | 9/1970 | Germany | 292/142 |
| 2,345,496 | 3/1975 | Germany | 292/142 |
| 2,129,517 | 12/1972 | Germany | 292/142 |
| 2,303,135 | 7/1974 | Germany | 292/142 |
| 2,344,971 | 3/1975 | Germany | 292/142 |

*Primary Examiner*—Roy D. Frazier
*Assistant Examiner*—Thomas J. Holko
*Attorney, Agent, or Firm*—Andrus, Sceales, Starke & Sawall

[57] ABSTRACT

Door- or window closure comprising a housing with an operating mechanism for locking elements. The housing consists of a one piece U-profiled member of which the base supports a rotatable pinion coupled to an operating member and to a rack guided in a closing plate coupled to the locking elements. The housing further comprises two guide parts on either side of the U-profile connected to the respective side, said assembly defining spacings for a member securing the closing plate.

8 Claims, 6 Drawing Figures

FIG: 2.
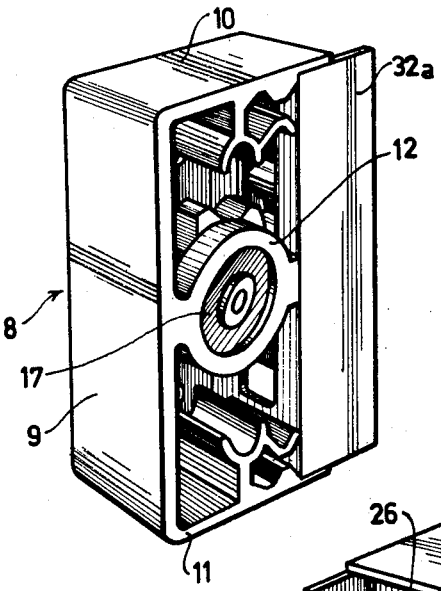
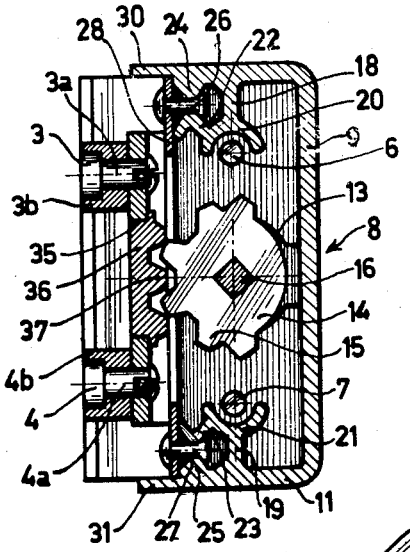
FIG: 3.
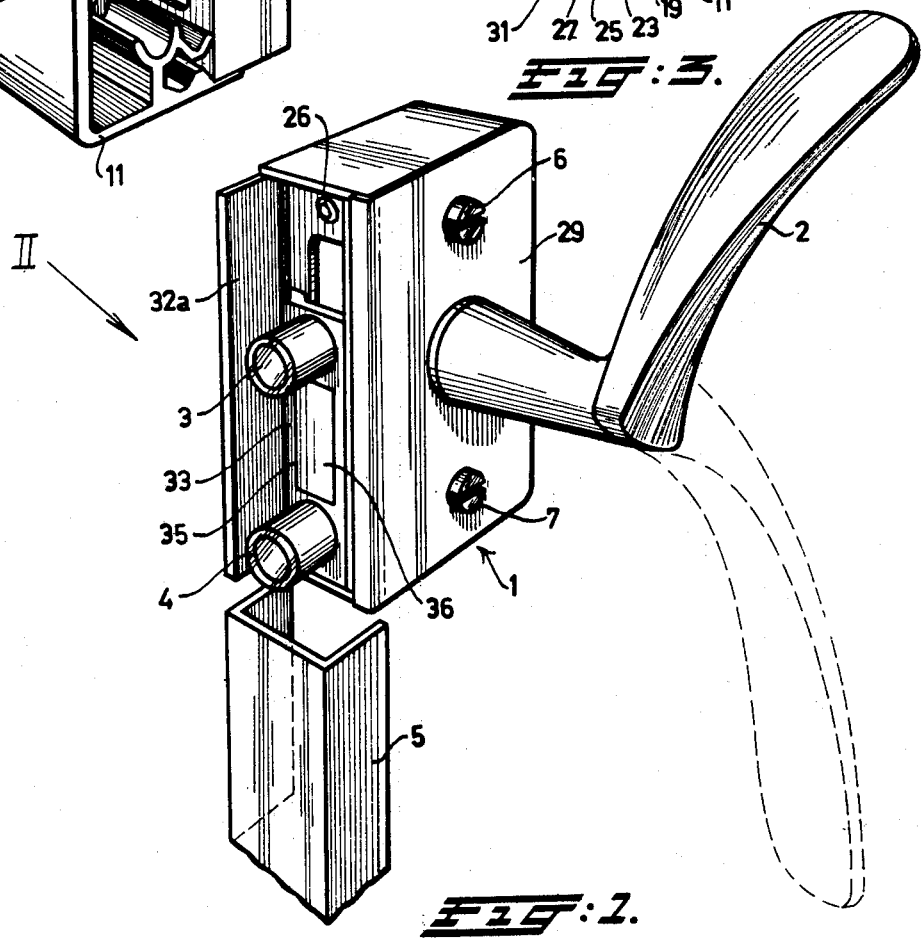
FIG: 1.

DOOR OR WINDOW CLOSURE

BACKGROUND OF THE INVENTION

The invention relates to a door- or window closure comprising a housing to be secured to the door or window and an operating mechanism for locking members.

Such closures are known per se in many versions. They are mostly constructed from parts obtained by punching and pressing sheet metal or by cutting them from solid metal; these operations are, however, complicated and expensive.

SUMMARY OF THE INVENTION

The invention aims to provide a closure, most parts of which can be manufactured from light metal- or extruded synthetic sections, a construction which is simple but nevertheless very solid.

This is attained by the arrangement that the housing consists of a one piece U-profiled member the base of which supporting a guide for rotatably bearing a pinion therein coupled to an operating member. On either side of the U-profile spaced from the end thereof a guide part is situated within the housing and connected via a bridge part, to the respective side, which defines, together with the side, a space for a securing member for connecting the section with a closing plate, closing the open front end of the section. A sliding piece is guided herein which carries the locking members and a rack which through an elongate hole in the closing plate is in mesh with the pinion.

Preferably a portion of the guide part has a central concave shape such that guide faces for screws serving to secure the housing to the door or window are produced.

The closing plate is preferably provided with twice bent over end edges and the sliding piece consists of two longitudinal edges, confined between the bent over edges, and a heightened central portion, connecting the longitudinal edges, in which at least one opening is provided in which fits a coupling member carried by the rack.

Each locking member comprises preferably a locking roller rotatable about a shaft protruding from the sliding piece. This is convenient as thus the closure is easily operable and can be tightened over a large track.

The closing plate and the locking members are situated between the extensions of the U-section sides whereby a short closure is produced. Closing plate and sliding piece can possibly extend beyond the housing, which allows to space the locking members thusly from the housing that the door or the window is locked in the proximity of its upper side, lower side respectively.

The guide can be obtained by means of at least one bearing block situated between the base and the closing plate or a guide fork protruding from the base and being open at the side remote of the base, or by at least a guide eye protruding from the base.

The closure as described has the advantage over the known closures that the shaft of the operating member is properly supported which results in a long life time, an easy handling and ensures that no one sided load is applied to the housing of the closure.

SURVEY OF THE DRAWINGS:

FIG. 1 is a perspective view of the present closure;

FIG. 2 is a view in the direction of arrow II in FIG. 1;

FIG. 3 is a longitudinal section through the closure;

Figure 4:
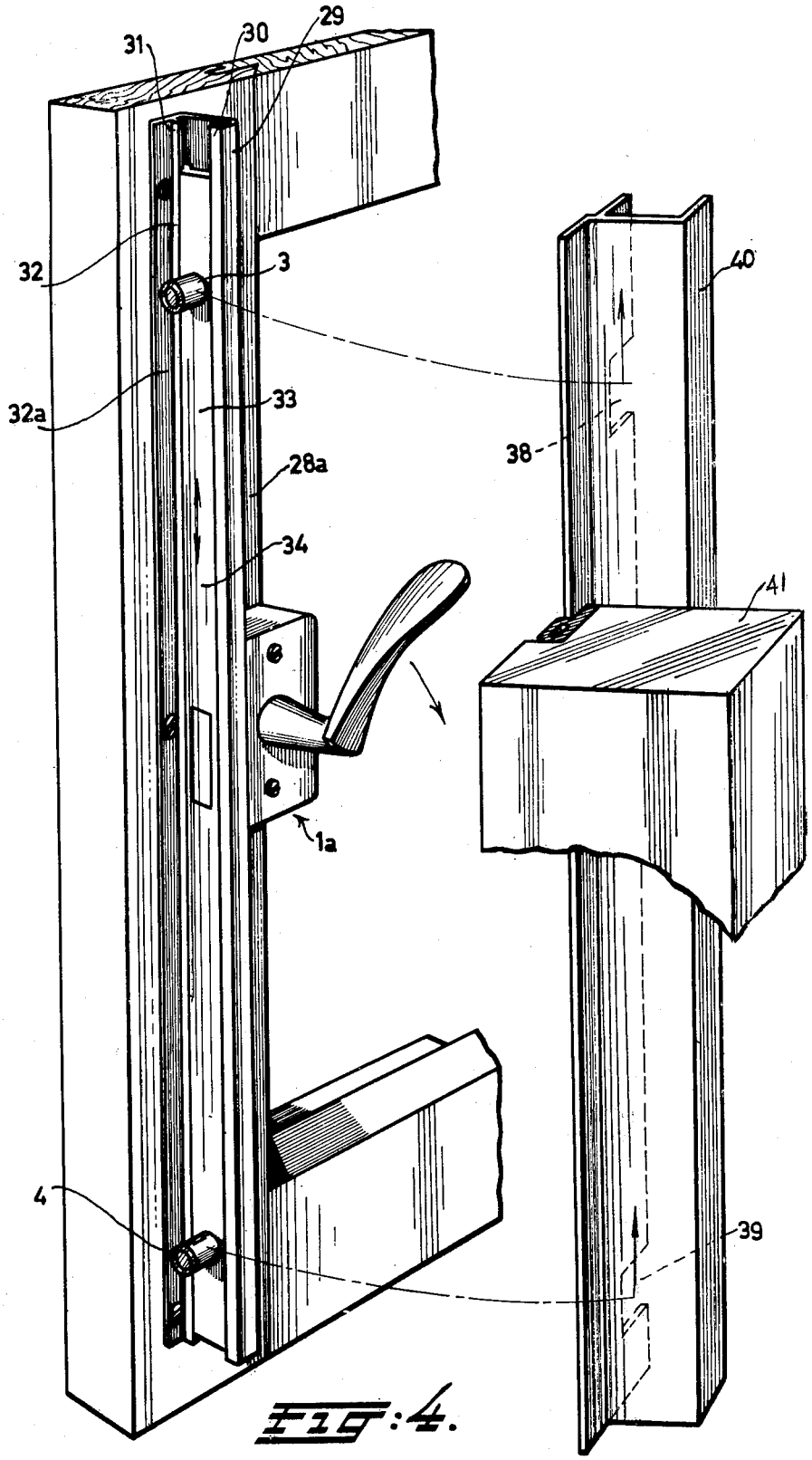
FIG. 4 is a perspective view of an embodiment of the closure in which the locking members are spaced from the housing.

DESCRIPTION OF PREFERRED EMBODIMENTS:

FIG. 1 shows the housing 1 of the closure from which protrude the operating handle 2 and the locking members 3, 4 the latter being designed to cooperate with suitable recesses in a profiled member 5 which, for the sake of clarity, has not been prolonged up to the level of the housing 1. The housing is secured to a part of a door or window (not shown) by means of screws 6, 7 protruding through the housing.

The housing consists of a profiled member, as a whole denoted by the reference numeral 8 in FIGS. 2 and 3, having an oblong base 9 and upright sides 10, 11. From the base 9 extends at least one guide, for a pinion 14 with teeth 15, which is coupled to guide rings 17 via a central square hole 16 and the shaft (not shown) of the handle 2. The embodiment of FIG. 2 shows two eyes 12, 13 between which the pinion 14 is confined.

From sides 10, 11 protrude bridge parts 18 and 19 which merge into an arched guide part 20, 21 respectively continuing in a hook-shaped part 22, 23 respectively turned towards the sides 10, 11 respectively. The hook-shaped parts 22 and 23 are located opposite corresponding ridges 24, 25 on sides 10, 11, respectively.

The inwardly directed faces of the guide parts 20, 21 constitute guide faces for the screws 6, 7, respectively on securing the closure to window or door. The spaces defined by parts 22, 24 on the one hand and parts 23, 25 on the other hand serve to accommodate a securing member like a tack 26, 27 by which the closing plate 28 is secured on the open front side of the section. The side of the section remote of the window or door is covered by a cover plate 29 being retained by screws 6, 7.

In this embodiment the closing plate 28 is confined between the extensions 30, 31 respectively of the sides 10 and 11, but another embodiment is possible in which the closing plate is elongated on either side of the housing; this embodiment is shown in FIG. 4.

FIG. 4 shows the shape of the closing plate denoted by the reference numeral **28*a*. The closing plate is constructed with twice bent over edges 29, 30 and 31, 32 respectively and an upright flange 32*a*, so that an additional securing, via this flange, to the window or door is possible. Confined between the edges 29, 30, 31, 32 is the sliding piece 33 consisting of two oblong end edges, confined between the bent over edges 29 . . . . 32, and a heightened central piece 34 carrying the locking members 3, 4. Each locking member comprises a shaft 3*a*, 4*a*, respectively, secured to the closing plate and a roller 3*b*, 4*b*, respectively encircling that shaft. An elongate hole 35 is provided in a piece 34 in which the back 36 of rack 37 closely fits. A rotation of the pinion 14 while the teeth 15 thereof are in mesh with rack 37 results in a movement in a longitudinal direction of the rack 37 and a corresponding movement of the locking members 3, 4**.

In the embodiment of FIG. 4 the locking members **3*a*, 4*a* are located at a considerable distance above, below, respectively the housing 1*a* of the closure. They cooperate with openings 38 and 39, in a section 40 secured to the doorcase, window frame, 41** respectively.

The present closure has besides a very simple construction an extensive field of application and presents the particular advantage that most parts can be obtained from lengths of light metal or extruded synthetic sections. This applies also to the housing 8, the pinion 14, the rack 37, the closing plate 28 and the sliding piece 33. It is not necessary to machine finish the surface of those parts, while the manufacture and assembly are very simple and no skilled people are required therefor.

Figure 5:
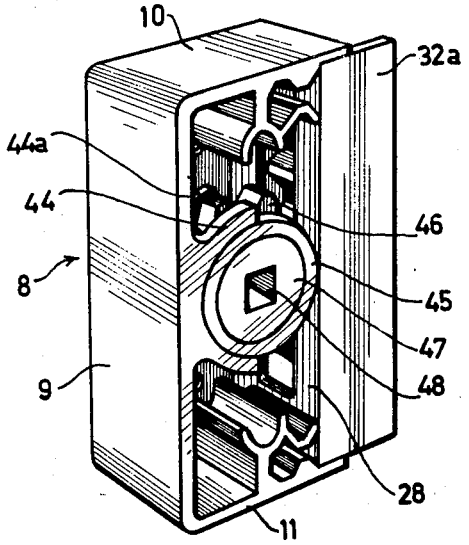
FIG. 5 is a perspective view of a second embodiment of the housing.
Figure 6:
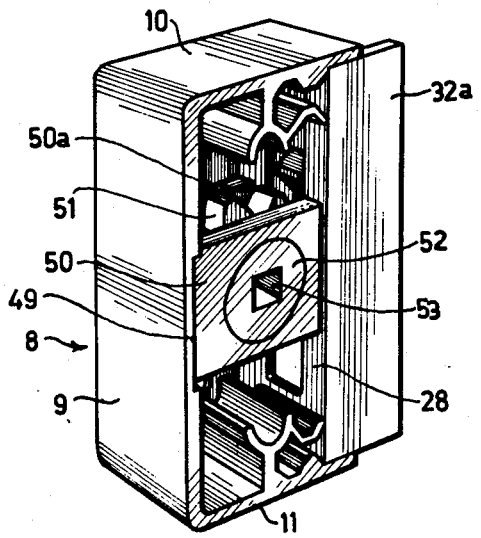
FIG. 6 is a perspective view of a third embodiment of the housing.

FIGS. 5 and 6 show slightly modified embodiments of the housing which differ from the embodiments as described hereinbefore by the way in which the pinion is guided in the housing. Said FIGS. 5 and 6 show parts corresponding to those in the other drawings and therefore having the same reference numerals.

In the embodiment of FIG. 5 at least one guide fork 44 protrudes from the base 9. A guide ring 45 is accommodated between the guide fork 44 and the closing plate 28 for rotatably receiving a ring 47 coupled to a pinion 46 through which protrudes shaft 48 of a handle (not shown). The drawing shows a second guide fork 44*a* behind pinion 46. Fork 44 with its matching ring 45 can, however, be manufactured in such a width, that in combination with the guiding of the teeth in the closing plate, only one fork suffices to produce a sufficient guide.

FIG. 6 shows an embodiment having an elongate recess 49 in the base 9 with at least one guide block 50 between base 9 and closing plate 28 which accommodates a guide ring 52 which is coupled to the pinion 51. Shaft 53 of the operating handle (not shown) protrudes through said ring.

If the block 50 has a sufficient width, only one guide block need be used. The drawing shows an embodiment with two guide blocks; the rear guide block is denoted by the reference numeral 50*a*.

Naturally, means (not shown), for instance a retaining ring should ensure that the shaft 48, 53 respectively does not shift in a longitudinal direction. When a detachable retaining element is used one set of parts is sufficient for obtaining a closure with leftward or rightward rotation by inserting the shaft from the right side.

The advantage of the embodiments of FIGS. 5 and 6 is the very convenient assembly of the same, as prior to the assembly of the complete closure the pinion with guide rings can be mounted on the shaft of the handle. Thus the combination can be put in place in the housing in one single operation.

Moreover the embodiment of FIG. 6 presents the advantage that the housing can be manufactured by a minor number of operations.

What is claimed is:

1. A door or window closure comprising:

a one piece housing suitable for attachment to the door or window, said housing comprising a section of predetermined width of a generally U-shaped extrusion having a base wall with side walls extending therefrom at either end, concave guide means within said housing and opening toward the interior of said housing for guiding fastener means extending through said housing, one such guide means being mounted on an intermediate portion of the inner surface of each of said side walls by a bridge member which spacedly positions said guide means from said side wall, a first ridge on the inner surface of each of said side walls adjacent the free end thereof, each of said guide means having a second ridge positioned in opposition to one of said first ridges for forming a narrow opening to a larger space defined by said first and second ridges and said bridge member, said guide means, bridge members, and first and second ridges extending across the width of said housing;

a pinion rotatably journalled in said base wall of said housing, said pinion being coupled to an operating member for said closure;

a closing plate extending across the open end of said U-shaped section and joined to said housing by fasteners extending through said narrow openings between said first and second ridges, said closure plate having an opening in the central portion thereof; and a slide member slideably retained on the exterior of said closing plate for movement in a plane parallel to said base wall, said slide member having at least one locking member projecting therefrom, said slide member having a rack extending through the opening in said closing plate into the interior of said housing and into engagement with said pinion for providing movement to said slide member upon rotation of said pinion.

2. The closure according to claim 1, wherein each locking member comprises a locking roller rotatable about a shaft projecting from the slide member.

3. The closure according to claim 1, wherein the closing plate and the locking member are situated between the extended side walls of the U-section.

4. The closure according to claim 1, wherein the closing plate and the slide member extend beyond the housing.

5. The closure according to claim 1, including at least one separable journal for said pinion positioned between the base wall and closing plate.

6. The closure according to claim 1 including a journal for said pinion comprising at least one journal fork extending from the base wall and open at the side remote of the base wall.

7. The closure according to claim 1, including a bearing for said pinion extending from said base wall interiorly of said housing.

8. The closure according to claim 1 wherein said closing plate is provided with twice bent over edges providing a generally C-shaped cross section to said plate for receiving said slide member.

* * * * *